US008682238B2

(12) United States Patent
Okamura

(10) Patent No.: US 8,682,238 B2
(45) Date of Patent: Mar. 25, 2014

(54) GROUNDING STRUCTURE, SHEET TRANSPORT APPARATUS, AND IMAGE FORMATION APPARATUS

(75) Inventor: Takuya Okamura, Ibaraki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 336 days.

(21) Appl. No.: 12/883,522

(22) Filed: Sep. 16, 2010

(65) Prior Publication Data

US 2011/0236098 A1 Sep. 29, 2011

(30) Foreign Application Priority Data

Mar. 24, 2010 (JP) ..... P2010-068319

(51) Int. Cl.
*G03G 15/00* (2006.01)

(52) U.S. Cl.
USPC ..... 399/388; 399/381

(58) Field of Classification Search
USPC ..... 399/388
See application file for complete search history.

(56) References Cited

U.S. PATENT DOCUMENTS

| | | | | |
|---|---|---|---|---|
| 2,548,534 | A * | 4/1951 | Hutchison, Jr. | 242/364.2 |
| 3,611,028 | A * | 10/1971 | Whitmore | 492/56 |
| 4,049,343 | A * | 9/1977 | Hermanson | 399/131 |
| 4,268,125 | A * | 5/1981 | Carter | 359/872 |
| 4,760,646 | A * | 8/1988 | Siegler | 30/382 |
| 4,826,337 | A * | 5/1989 | Unuma | 400/616.2 |
| 4,918,865 | A * | 4/1990 | Hirai | 49/347 |
| 5,152,631 | A * | 10/1992 | Bauer | 403/372 |
| 5,283,621 | A * | 2/1994 | Hashizume | 399/331 |
| 7,267,502 | B2 * | 9/2007 | Sawai | 400/641 |
| 7,328,785 | B2 * | 2/2008 | Hart et al. | 198/781.1 |
| 7,661,884 | B2 * | 2/2010 | Jo | 384/277 |
| 7,761,035 | B2 * | 7/2010 | Tokarski et al. | 399/159 |

FOREIGN PATENT DOCUMENTS

| | | |
|---|---|---|
| JP | 2001-341881 A | 12/2001 |
| JP | 2004-217358 A | 8/2004 |
| JP | 2008-68989 A | 3/2008 |

* cited by examiner

*Primary Examiner* — Anthony Nguyen
(74) *Attorney, Agent, or Firm* — Sughrue Mion, PLLC

(57) ABSTRACT

A grounding structure includes a rotation shaft and a grounding member. The rotation shaft has a non-circular cross section, and rotates. The grounding member is attached to the rotation shaft to electrically communicate with the rotation shaft, and rotates together with the rotation shaft. The grounding member includes a first grounding portion, a grounding retainer and a second grounding portion. An outer shape of the first grounding portion is a circular shape. The grounding retainer is provided on a side of the first grounding portion in a shaft direction of the rotation shaft, and has an outside diameter being larger than an outside diameter of the first grounding portion. The second grounding portion is elastically held in contact with the first grounding portion.

18 Claims, 11 Drawing Sheets

GROUNDING STRUCTURE, SHEET TRANSPORT APPARATUS, AND IMAGE FORMATION APPARATUS

CROSS-REFERENCE TO RELATED APPLICATION

This application is based on and claims priority under 35 USC 119 from Japanese Patent Application No. 2010-068319 filed on Mar. 24, 2010.

BACKGROUND

Technical Field

The present invention relates to a grounding structure, a sheet transport apparatus, and an image formation apparatus.

SUMMARY

[1] According to an aspect of the invention, a grounding structure includes a rotation shaft and a grounding member. The rotation shaft has a non-circular cross section, and rotates. The grounding member is attached to the rotation shaft to electrically communicate with the rotation shaft, and rotates together with the rotation shaft. The grounding member includes a first grounding portion, a grounding retainer and a second grounding portion. An outer shape of the first grounding portion is a circular shape. The grounding retainer is provided on a side of the first grounding portion in a shaft direction of the rotation shaft, and has an outside diameter being larger than an outside diameter of the first grounding portion. The second grounding portion is elastically held in contact with the first grounding portion.

BRIEF DESCRIPTION OF THE DRAWINGS

Exemplary embodiments of the invention will be described in detail based on the following figures, wherein:

FIGS. 9A and 9B are views showing the grounding member and the rotation shaft of another exemplary embodiment in which FIG. 9A is an elevational view and FIG. 9B is an elevational cross-sectional view;

DETAILED DESCRIPTION

A description will be given hereinbelow of an exemplary embodiment of the present invention with reference to the drawings.

First, a description will be given of a basic structure and operation of a printer (image formation apparatus) according to an exemplary embodiment to which the present invention is applied.

Figure 1:
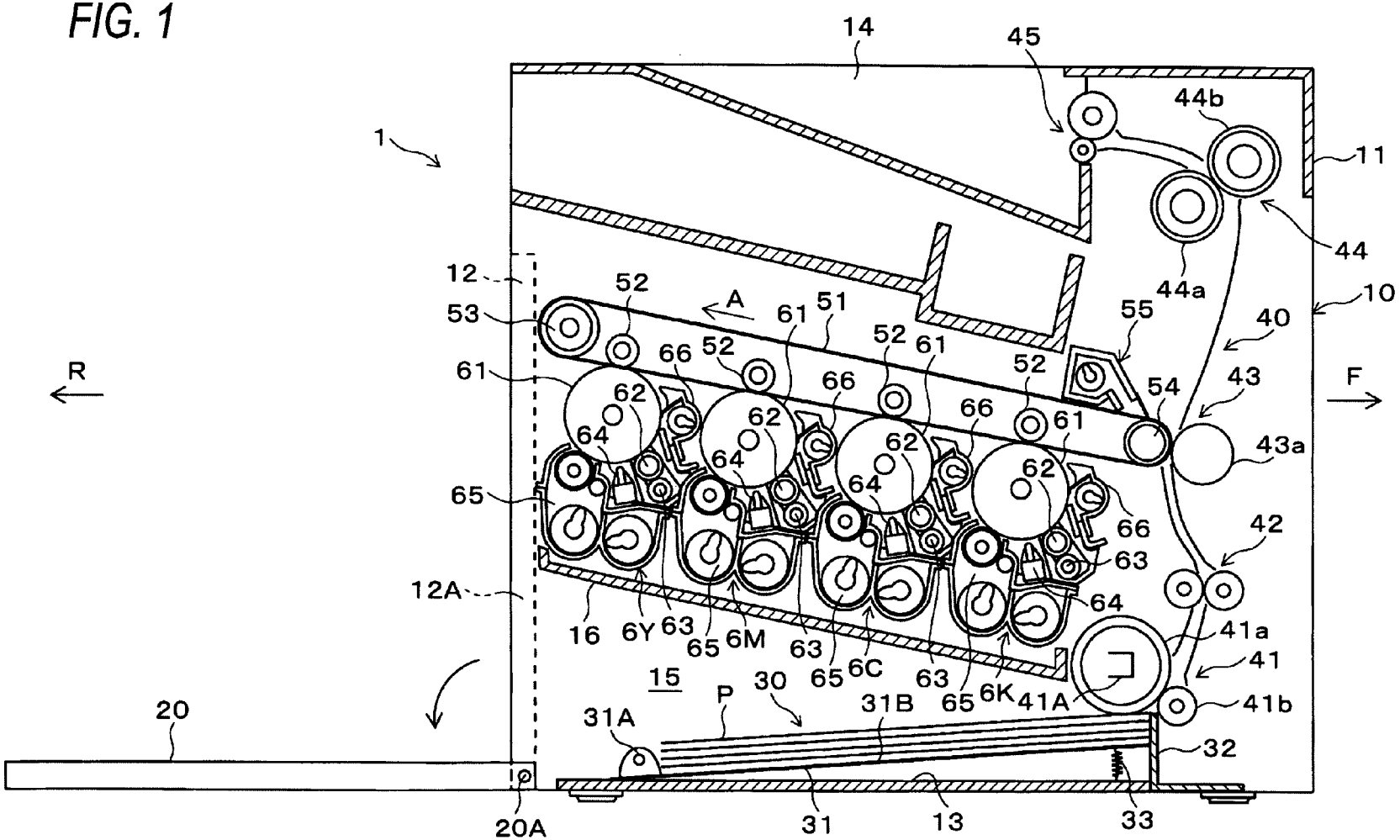
FIG. 1 is a side view showing an internal structure of a printer according to an exemplary embodiment of the present invention.

FIG. 1 shows an internal structure of a printer 1 according to the exemplary embodiment. In the drawing, a reference numeral 10 denotes an apparatus main body having a cabinet 11. A rear surface (a direction R is a rearward direction in FIG. 1) of the apparatus main body 10 is opened, and an opening 12 is opened and closed with a cover 20. In the following description, a forward or rearward direction and an upward or downward direction denote directions in the apparatus main body 10 in which the direction R corresponds to the rearward direction, and a direction F corresponds to a forward direction. A lower end of the cover 20 is hinge-coupled to the apparatus main body 10 via a hinge shaft 20A extending in a lateral direction (a frontward and backward direction in the drawing of FIG. 1 when the drawing is viewed in three dimensions), and the cover 20 is opened and closed in a tilting manner in forward and rearward directions.

Figure 3:
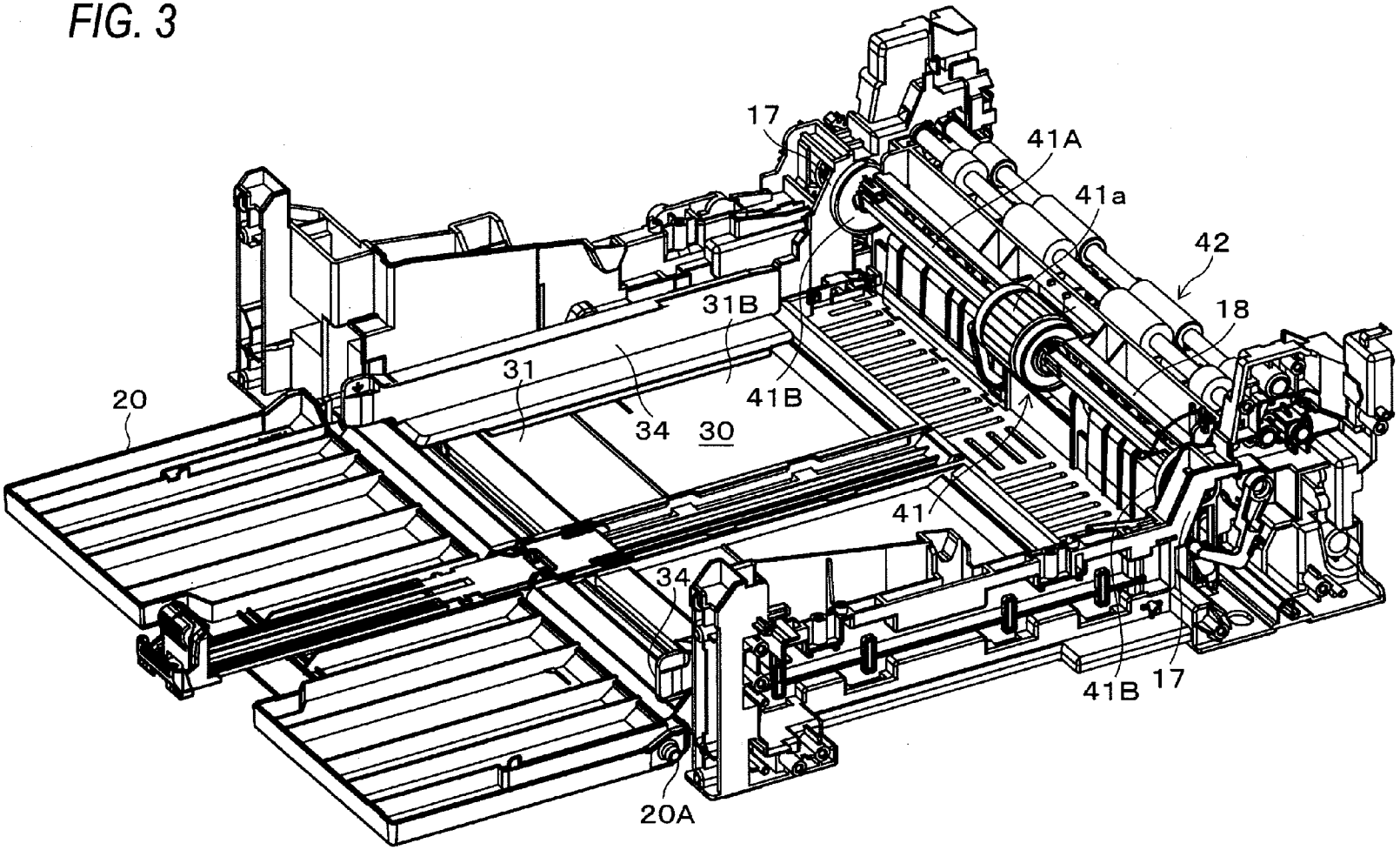
FIG. 3 is a perspective view showing a sheet feed mechanism provided on a bottom portion of an apparatus main body of the printer.

On the bottom portion of the apparatus main body 10, a sheet feed tray 30 is provided. The sheet feed tray 30 includes a sheet stacking plate 31 with its rear end portion hinge-coupled to a bottom plate portion 13 of the apparatus main body 10 via a rotation shaft 31A, and a raised plate portion 32 disposed on the forward side of the sheet stacking plate 31 and fixed to the bottom plate portion 13. The sheet stacking plate 31 is biased so as to upwardly rotate about the rotation shaft 31A as a pivot by a coil spring 33 fixed to the bottom plate portion 13. An upper surface of the sheet stacking plate 31 serves as a sheet stacking surface 31B, and a large number of sheets P are stacked on the sheet stacking surface 31B. As shown in FIG. 3, on both sides of the sheet stacking surface 31B, there are provided regulating plates 34 that laterally slide in synchronization with each other, and contact both end edges of the sheet P to set the position of the sheet in a width direction at the center of the sheet stacking surface 31B.

The sheets P stacked on the sheet stacking surface 31B of which the position in the width direction is set by the regulating plates 34 are pulled out forwardly from the top thereof one by one by a sheet feed mechanism (sheet transport apparatus) 41, moved upwardly along a sheet transport path 40 formed on the forward side in the apparatus main body 10, and discharged onto a sheet discharge tray 14 formed on an upper surface of the apparatus main body 10.

The printer 1 is a tandem-type full color printer and, in the apparatus main body 10, there are incorporated a transfer belt 51 that is rotatably stretched in a tilting manner with its rear side raised (left upward direction in FIG. 1), and rotates in a direction indicated by an arrow A, image formation units of four colors 6Y, 6M, 6C, and 6K that are arranged in parallel with each other under the transfer belt 51, a secondary transfer section (image formation section) 43, and a fixing section 44. The image formation units 6Y, 6M, 6C, and 6K are disposed in parallel with the tilt direction of the transfer belt 51. Under the image formation units 6Y, 6M, 6C, and 6K, a partition plate 16 is disposed to oppose the sheet stacking plate 31 with space 15 interposed between the partition plate 16 and the sheet stacking plate 31. The partition plate 16 is provided in parallel with the tilt direction of the transfer belt 51 under the image formation units 6Y, 6M, 6C, and 6K.

The four image formation units 6Y, 6M, 6C, and 6K respectively form toner images of yellow (Y), magenta (M), cyan (C), and black (B), and have the same basic structure. The four image formation units 6Y, 6M, 6C, and 6K include photosensitive drums 61, charging rollers 62 disposed around the photosensitive drums 61, charging roller cleaners 63, image exposure apparatuses 64, developing units 65, and photosensitive drum cleaners 66.

To the printer 1, color image information is inputted from a personal computer and the like and, when the color image information is inputted, four light beams in correspondence to the individual colors are emitted from the image exposure apparatuses 64. The light beams scan the surfaces of the rotating photosensitive drums 61 charged by the charging rollers 62. With this operation, electrostatic latent images of the individual colors are formed on the surfaces of the individual photosensitive drums 61.

The electrostatic latent images formed on the photosensitive drums 61 are developed by the developing units 65 using developing agents including toners of the individual colors, the developed toner images (color images) are primarily transferred to the surface (outer surface) of the rotating transfer belt 51 by primary transfer rollers 52. Such primary transfer operation of the development from the photosensitive drums 61 to the transfer belt 51 is successively performed at a predetermined timing in the individual image formation units 6Y, 6M, 6C, and 6K, and a full color image is formed on the surface of the transfer belt 51 when the transfer belt 51 passes the image formation unit 6K of the black color on the most downstream side.

There are cases where a residue such as a toner, a corona product, or the like is adherent to the surfaces of the photosensitive drums 61 after the primary transfer, but the residue is removed by the photosensitive drum cleaners 66. The surfaces of the photosensitive drums 61 are recharged by the charging rollers 62. Note that the residue that is not removed by the photosensitive drum cleaners 66, and adherent to the charging rollers 62 is removed by the charging roller cleaners 63 that rotate in contact with the charging rollers 62.

The transfer belt 51 is wound around a drive roller 53 and a backup roller 54, and rotates in a direction indicated by the arrow A by the rotation of the drive roller 53. Inside the transfer belt 51, there are disposed primary transfer rollers 52 that form nips by nipping the transfer belt 51 between the inside of the transfer belt 51 and the photosensitive drums 61 of the image formation units 6Y, 6M, 6C, and 6K.

The full color toner image formed on the transfer belt 51 is transferred, in a secondary transfer section 43, to the sheet P that is pulled out from the sheet feed tray 30 by the sheet feed mechanism 41 and, moved upwardly along the sheet transport path 40 at an appropriate timing. The sheet feed mechanism 41 includes a sheet feed roller (transport roller) 41*a* and a sheet separation roller 41*b*, and the sheets P are separated one by one, forwardly pulled out, temporarily transported to a pair of resist rollers 42 positioned upward, and halted by the sheet feed mechanism 41. Subsequently, the sheets P are sent to the secondary transfer section 43 by the pair of resist rollers 42 that is driven to be rotated at a predetermined timing.

The secondary transfer section 43 is comprised of the above-mentioned backup roller 54 around which the transfer belt 51 is wound, and a secondary transfer roller 43*a* that forms the nip with the backup roller 54. The sheet P passes between the rollers 54 and 43*a*, whereby the full color toner image on the transfer belt 51 is transferred to the sheet P. There are cases where a residue such as the toner or the like is adherent to the surface of the transfer belt 51 after the secondary transfer, but the residue is removed by a transfer belt cleaner 55 disposed upwardly of the forward end portion of the transfer belt 51.

The sheet P to which the full color toner image is transferred passes through the fixing section 44, and the color toner image is fixed on the sheet P in the fixing section 44. The fixing section 44 includes a heating roller 44*a* and a pressure roller 44*b* that forms the nip with the heating roller 44*a*. The sheet P passes between the rollers 44*a* and 44*b*, whereby the full color toner image is fixed onto the sheet P by the action of the pressure and heating. Subsequently, the sheet P having passed through the fixing section 44 is discharged onto the sheet discharge tray 14 by a pair of sheet discharge rollers 45. The sheet transport path 40 is constituted by a path extending from the sheet feed mechanism 41 to the pair of sheet discharge rollers 45 via the pair of resist rollers 42, the secondary transfer section 43, and the fixing section 44.

Since the partition plate 16 is tilted with the rear portion raised in parallel with the transfer belt 51, the space 15 mentioned above becomes wider in an upward and downward direction as it goes toward the rear. A portion of the opening 12 mentioned above communicating with the space 15 serves as a sheet supply opening 12A for supplying the sheet P on the sheet stacking plate 31 of the sheet feed tray 30. The sheet supply opening 12A and the sheet feed tray 30 are opened and closed with the cover 20.

Figure 2:
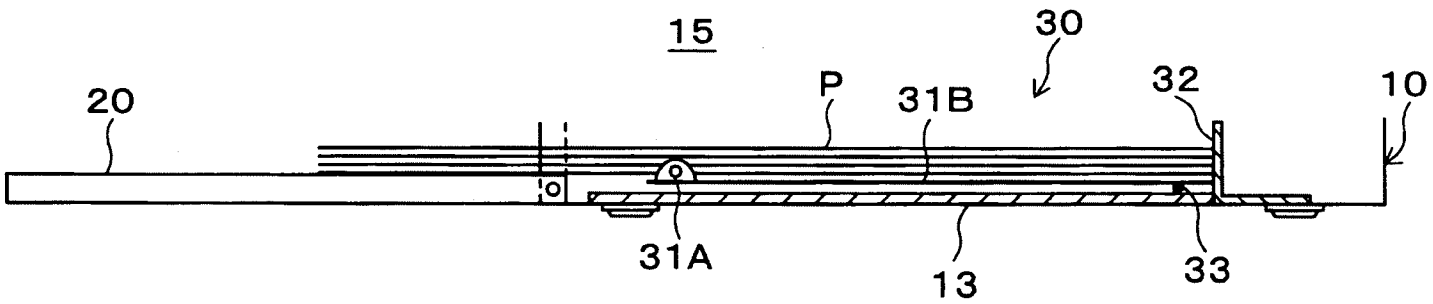
FIG. 2 is a side view showing a sheet feed tray and a cover of the printer in which a state where rear end portions of sheets of a large size accommodated in the sheet feed tray are placed on the opened cover.

When the sheet P is sent to the sheet transport path 40 to perform image formation, as shown in FIG. 1, the sheet stacking plate 31 is lifted upwardly by the coil spring 33, the upper surface of the leading end portion of the sheet P is pressed against the under surface of the sheet feed roller 41*a* of the sheet feed mechanism 41, and the sheet feed mechanism 41 is allowed to pull out the sheet P. On the other hand, when the image formation is not performed, the rear end portion of the sheet stacking plate 31 is pressed downward against the tension of the spring 33 by eccentric cams 41B (see FIG. 3) that rotate integrally with the sheet feed roller 41*a*, and the sheet stacking plate 31 is set at a sheet supply position in parallel with the bottom plate portion 13, as shown in FIG. 2.

The supply of the sheet P from the sheet supply opening 12A onto the sheet stacking plate 31 is performed in the state where the sheet stacking plate 31 is set at the sheet supply position. The sheet P is inserted until the leading end thereof is abutted on the raised plate portion 32, and stacked and accommodated on the sheet stacking plate 31. As shown in FIG. 2, the printer 1 is structured such that, in the state where the cover 20 is completely opened to be horizontal and the sheet P longer than the depth of the sheet feed tray 30 is supported with its rear end portion placed on an inner surface of the cover 20 directed upward, it is possible to supply the sheet P onto the sheet stacking plate 31 of the sheet feed tray 30.

Next, a detailed description will be given of the sheet feed mechanism 41 described above.

The sheet feed mechanism 41 includes the sheet feed roller 41*a* and the sheet separation roller 41*b*, as described above. The sheet feed roller 41*a* is coaxially fixed to a rotation shaft 41A that extends laterally, as shown in FIG. 3. The rotation shaft 41A is an angular tubular rod having a non-circular U-shaped cross section formed by sheet metal working, and both end portions thereof are rotatably supported on bearing portions 17 formed in the apparatus main body 10 via bearings (not shown). To the both end portions of the rotation shaft 41A, the above-mentioned eccentric cams 41B are fixed.

Figure 4:
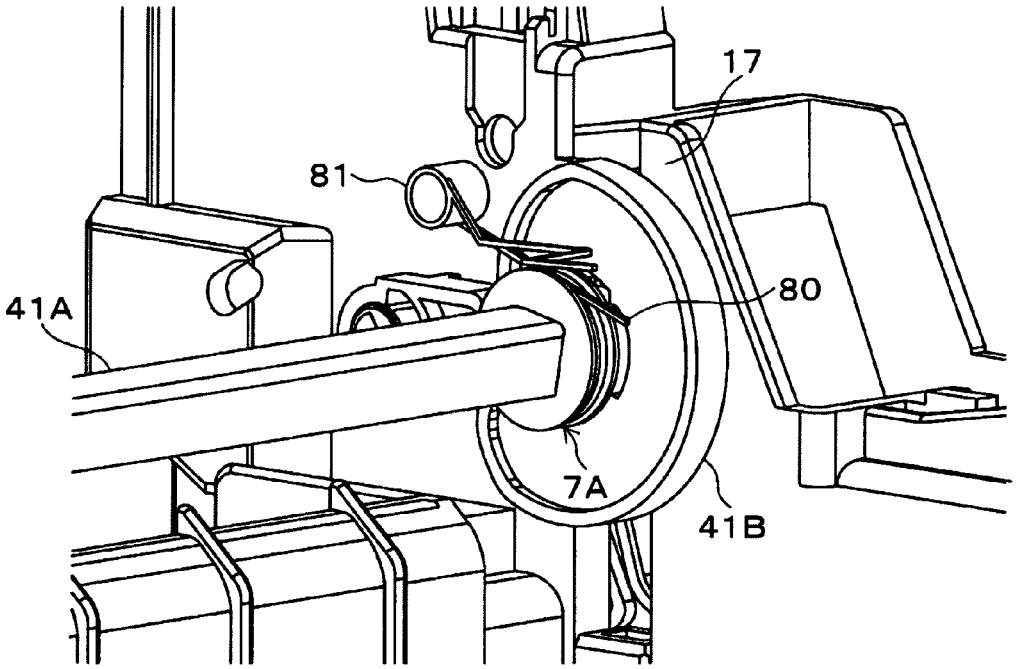
FIG. 4 is a perspective view showing a part of the sheet feed mechanism.
Figure 5:
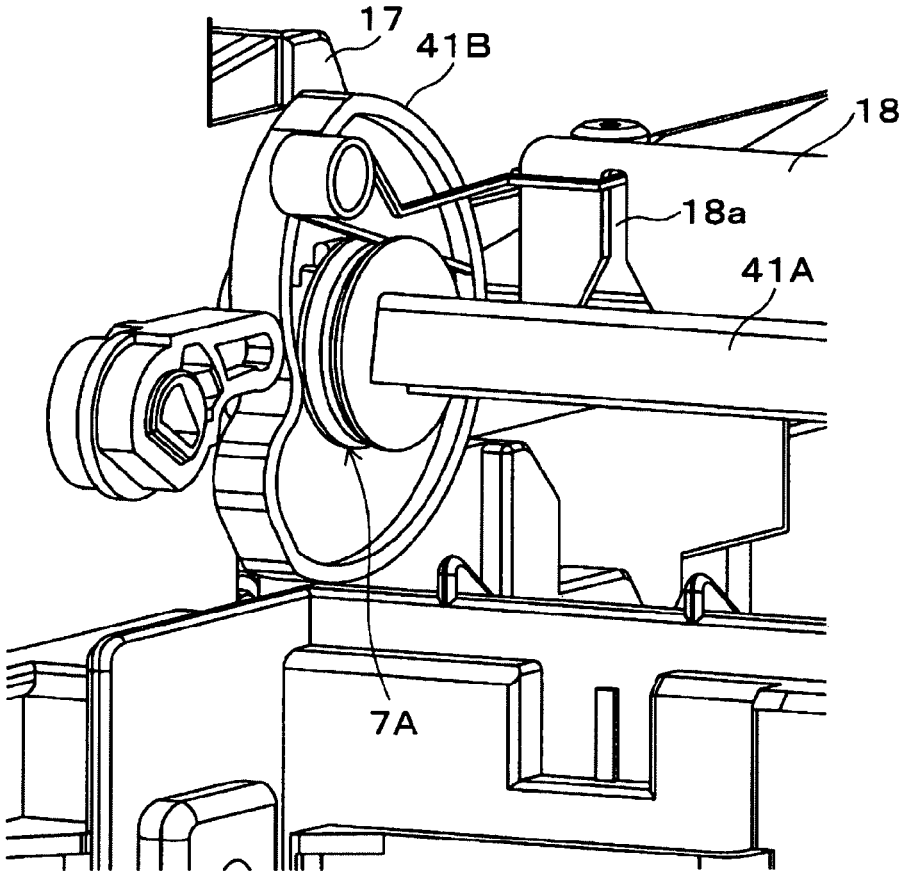
FIG. 5 is a perspective view showing a part of the sheet feed mechanism.
Figure 6:
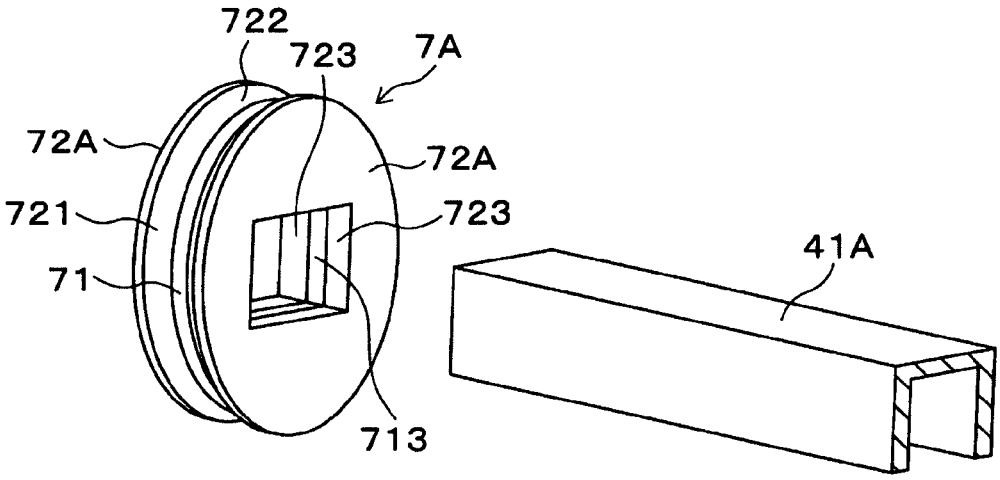
FIG. 6 is a perspective view showing a grounding member and a rotation shaft of the exemplary embodiment.
Figure 7:
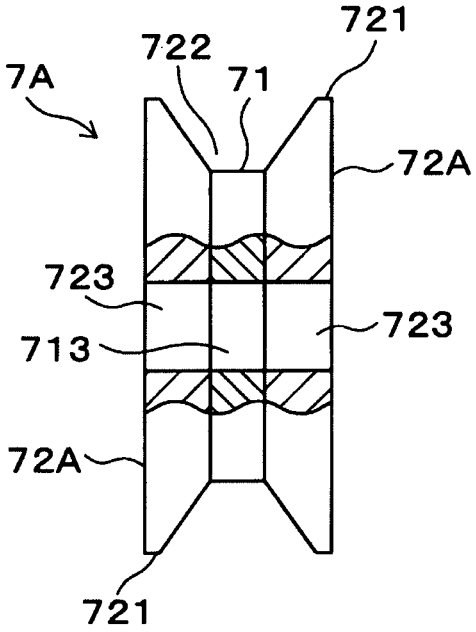
FIG. 7 is a partially cross-sectional, elevational view showing the grounding member of the exemplary embodiment.

As shown in FIGS. 4 and 5, on an inner side in an axial direction of the eccentric cam 41B in one end portion of the rotation shaft 41A, a disk-like grounding member 7A is provided coaxially with the rotation shaft 41A. As shown in FIGS. 6 and 7, the grounding member 7A is comprised of a metal disk 71 (first grounding portion) having conductivity, and two non-conductive grounding retainers 72A that are fixed by sandwiching the disk 71.

The grounding retainers 72A are made of a resin or the like, and each of outer circumferential portions thereof has an outside diameter larger than that of the disk 71. On the outer circumferential portions, there are formed tapered convex stripes 721 (restraint portion) of which diameters increase in a direction in which they are spaced apart from each other in the axial direction. Between the convex stripes 721, a V-shaped circumferential groove 722 is formed, and an outer circumferential surface of the disk 71 is exposed on the bottom portion of the circumferential groove 722. In the disk 71 and the grounding retainers 72, there are formed shaft holes 713 and 723 having rectangular cross sections into which the rotation shaft 41A is fitted to extend therethrough, and the insertion of the rotation shaft 41A into the shaft holes 713 and 723 allows the grounding member 7A to move in the axial direction along the rotation shaft 41A.

As shown in FIGS. 4 and 5, one end portion of a spring member (second grounding portion) 80 comprised of a metal helical torsion coil spring having conductivity is fitted onto the circumferential groove 722 of the grounding member 7A, and the spring member 80 is elastically held in contact with the outer circumferential surface of the disk 71. A wound portion 81 of the spring member 80 is rotatably fitted over a pin (not shown) formed on the apparatus main body 10. As shown in FIG. 5, the other end portion of the spring member 80 opposite to the one end portion engaged with the circumferential groove 722 of the grounding member 7A is inserted into an engagement hole 18*a* of a bracket 18 fixed to the apparatus main body 10, and is engaged with the bracket 18. The spring member 80 with the end portions engaged with the bracket 18 and the circumferential groove 722 of the grounding member 7A is elastically held. The grounding member 7A is biased in the direction of the rotation shaft 41A by the spring member 80, and the inner surface of the disk 71 on the rear side in the direction of the biasing is constantly pressed against the rotation shaft 41A.

With the contact of the one end portion of the spring member 80 with the convex stripes 721 on both sides of the circumferential groove 722, an axial movement of the grounding member 7A is restrained, and the detachment of the one end portion of the spring member 80 from the circumferential groove 722 is prevented.

The sheet feed mechanism 41 of the present exemplary embodiment is comprised of the rotation shaft 41A, the grounding member 7A, and the spring member 80 in addition to the sheet feed roller 41*a* and the sheet separation roller 41*b*. In the grounding member 7A of the present exemplary embodiment, the disk 71 constitutes the first grounding portion and a connection portion of the present invention, and static electricity generated in the rotation shaft 41A is conveyed to the bracket 18 from the disk 71 held in contact with the rotation shaft 41A via the spring member 80, discharged to the apparatus main body 10, and grounding is thus established. According to the grounding member 7A constituting the sheet feed mechanism 41 of the present exemplary embodiment, it is possible to adequately provide a grounding structure without bringing the spring member 80 for grounding into direct contact with the rotation shaft 41A having the angular cross section.

The above-described grounding member 7A is only one exemplary embodiment, and the structure is not limited thereto. Hereinbelow, an example of another exemplary embodiment will be given.

Figure 8:
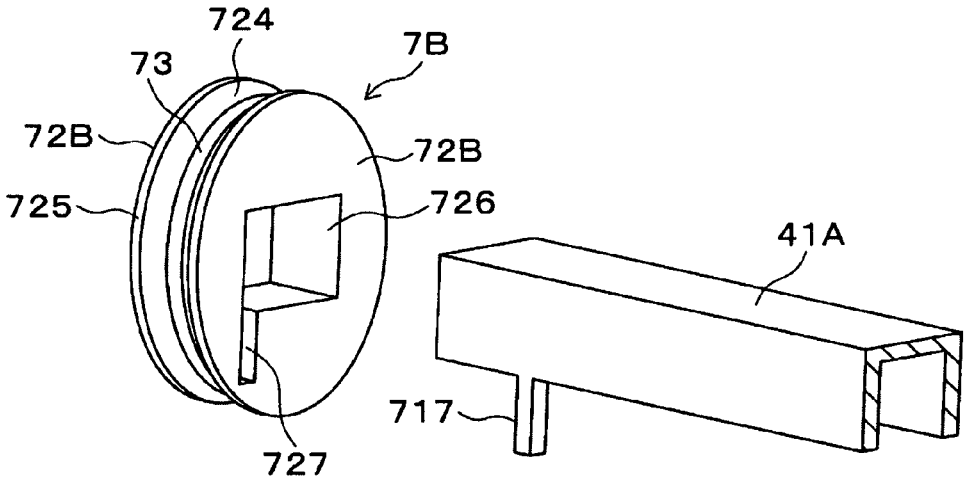
FIG. 8 is a perspective view showing a grounding member and a rotation shaft of another exemplary embodiment.
Figure 9A:
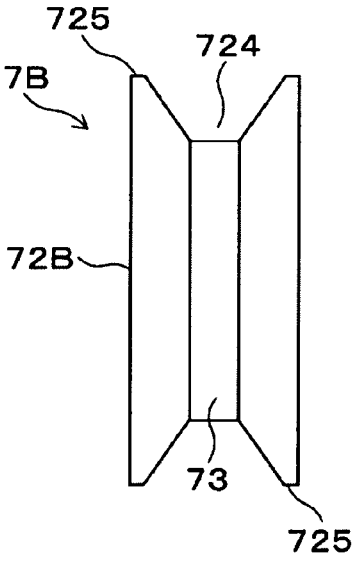
Figure 9B:
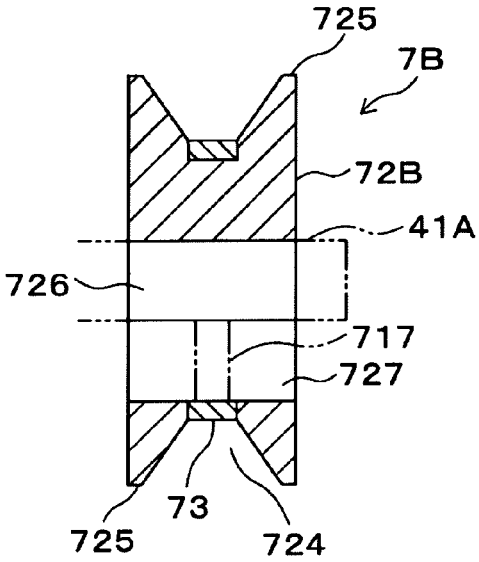
Figure 10:
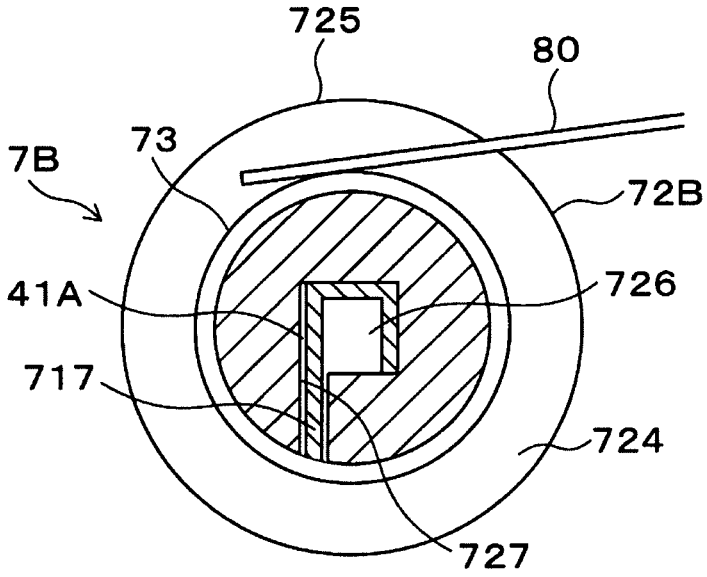
FIG. 10 is a partially cross-sectional, side view showing a state in which the grounding member of another exemplary embodiment is incorporated in an image formation apparatus.

In a grounding member 7B shown in FIGS. 8 to 10, a grounding retainer 72B made of a resin has a structure in which the above-described two grounding retainers 72A and disk 71 are integrally formed, and does not have the disk 71. On the outer circumferential surface of the grounding retainer 72B in this case, a circumferential groove 724 is formed, and convex stripes (restraint portion) 725 are formed on both sides of the circumferential groove 724. In addition, a metal ring (first grounding portion) 73 having conductivity is wound around the circumferential groove 724 to be fixed.

In the center of the grounding retainer 72B, there is formed a shaft hole 726 into which the rotation shaft 41A is inserted. On the portion of the rotation shaft 41A to be inserted into the grounding retainer 72B, there is formed a connection portion (protrusion portion) 717 that protrudes in a width direction. It is possible to form the connection portion 717 by stamping when the rotation shaft 41A is subjected to sheet metal working. In the grounding retainer 72B, a notch 727 into which the connection portion 717 of the rotation shaft 41A is inserted to allow the insertion of the rotation shaft 41A is formed to extend through the grounding retainer 72B in the axial direction. The notch 727 extends from the shaft hole 726 in a direction of the ring 73 to expose an inner circumferential surface of the ring 73. The rotation shaft 41A is inserted into the shaft hole 726 with the connection portion 717 fitted into the notch 727, and is inserted until the position of the connection portion 717 matches that of the ring 73. As shown in FIGS. 9A, 9B and 10, in the state where the rotation shaft 41A is inserted, the tip end of the connection portion 717 of the rotation shaft 41A is held in contact with the inner circumferential surface of the ring 73, and one end portion of the spring member 80 is brought into contact with the ring 73.

In the grounding member 7B of the present exemplary embodiment, the ring 73 constitutes the first grounding portion of the present invention, and static electricity generated in the rotation shaft 41A is conveyed from the connection portion 717 of the rotation shaft 41A to the ring 73 held in contact with the connection portion 717, discharged from the bracket 18 to the apparatus main body 10 via the ring 73 and the spring member 80, and grounding is thus established.

Figure 11:
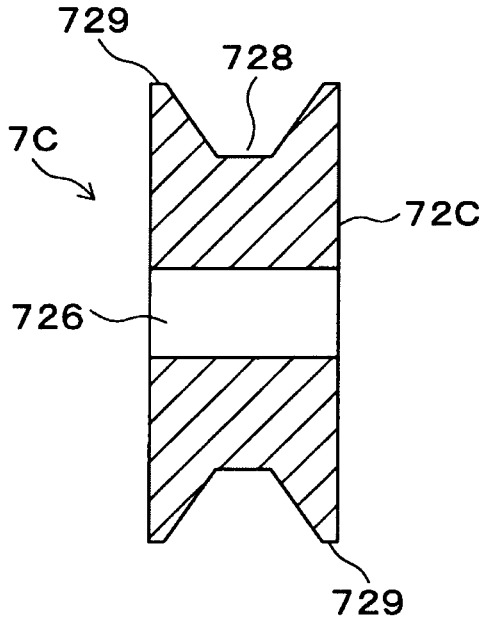
FIG. 11 is an elevational cross-sectional view of a grounding member of still another exemplary embodiment.

A grounding member 7C shown in FIG. 11 has a structure in which the above-described grounding retainer 72B and ring 73 are integrally formed, and is formed as an integral body made of a single material. The material is a resin having conductivity and, specifically, the entire grounding member 7C is comprised of a grounding member 72C made of the conductive resin. The grounding retainer 72C includes all of the first grounding portion, the connection portion, and the restraint portion of the present invention. In the grounding member 7C, a circumferential groove 728 is formed on an outer circumferential surface thereof, convex stripes (restraint portion) 729 are formed on both sides of the circumferential groove 728, and the shaft hole 726 through which the rotation shaft 41A extends is formed in the center of the grounding member 7C. In the grounding member 7C, one end portion of the spring member 80 is incorporated so as to be held in contact with the bottom portion of the circumferential groove 728.

According to the grounding member 7C of the present exemplary embodiment, it is possible to form the entire grounding member by using a single material (resin) made of the conductive material, and there is provided an advantage that the grounding member is easily manufactured. In addition, in the above-described grounding members 7A and 7B, although a manufacturing step of combining the conductive disk 71 or ring 73 with the grounding retainers 72A or the grounding retainer 72B is required, since the grounding retainers 72A and 72B are made of an inexpensive non-conductive resin, there is provided an advantage that it is possible to manufacture the grounding members 7A and 7B at low cost.

Note that the "grounding" means equalizing a potential to that of the earth. In addition, the "non-circular" means a concept that includes not only a rectangular configuration and a U configuration but also an oblong configuration. Further, the "circular cross-sectional configuration" may not be a perfect circle, and the configuration may appropriately have a continuous surface that allows proper contact with the second grounding portion. Furthermore, instead of the second grounding portion, the first grounding portion may have elasticity. Moreover, in the outer circumferential portion of each of the grounding retainers 72A, the outside diameter thereof may not be larger than that of the disk 71 over the entire circumference. Additionally, the grounding member of the present invention may also be applied to an image formation apparatus in which an inkjet method is adopted.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A grounding structure comprising:

a rotation shaft that has a non-circular cross section, and that rotates; and a grounding member that is attached to the rotation shaft to electrically communicate with the rotation shaft, and that rotates together with the rotation shaft, wherein the grounding member includes:

a first grounding portion of which outer shape is a circular shape;

a grounding retainer that is provided on a side of the first grounding portion in an axial direction of the rotation shaft, and that has an outside diameter that is larger than an outside diameter of the first grounding portion along an entirety of an outer periphery of the first grounding portion, wherein the grounding retainer completely surrounds the outer periphery of the first grounding portion when viewed along the axial direction of the rotation shaft; and a spring member that is elastically held in contact with the first grounding portion of the grounding member, wherein the grounding member is biased toward of the rotation shaft by the spring member.

2. The grounding structure of claim 1, wherein the grounding member is conductive in its entirety, and the grounding member includes a restraint portion which restrains the grounding member from moving in the axial direction of the rotation shaft.

3. The grounding structure of claim 2, wherein the first grounding portion is sandwiched between two grounding retainers that form a circumferential groove; and each of the two grounding retainers includes a convex stripe as the restraint portion, and the convex stripe is present on an outer side of the circumferential groove in the axial direction of the rotation shaft.

4. A sheet transport apparatus comprising;

a grounding structure comprising:

a rotation shaft that has a non-circular cross section, wherein the rotation shaft transports a sheet and rotates; and a grounding member that is attached to the rotation shaft to electrically communicate with the rotation shaft, and that rotates together with the rotation shaft, wherein the grounding member includes:

a first grounding portion having a circular outer shape;

a grounding retainer that is provided on a side of the first grounding portion in an axial direction of the rotation shaft, and that has an outside diameter that is larger than an outside diameter of the first grounding portion along an entirety of an outer periphery of the first grounding portion, wherein the grounding retainer completely surrounds the outer periphery of the first grounding portion when viewed along the axial direction of the rotation shaft; and a spring member that is elastically held in contact with the first grounding portion of the grounding member, wherein the grounding member is biased toward the rotation shaft by the spring member.

5. An image formation apparatus comprising:

an image formation section that forms an image on a sheet to be transported; and the sheet transport apparatus of claim 4.

6. The grounding structure of claim 1, wherein the first grounding portion and the grounding retainer are integrally formed, and comprises a single conductive material.

7. The grounding structure of claim 1, wherein the conductive material is a resin.

8. A grounding structure comprising:

a rotation shaft that has a non-circular cross section and includes a protrusion portion that protrudes in a direction perpendicular to an axial direction of the rotation shaft, and the rotation shaft rotates; and a grounding member that is attached to the rotation shaft to electrically communicate with the rotation shaft, and that rotates together with the rotation shaft, wherein the grounding member includes:

a first grounding portion of which outer shape is a circular shape;

a grounding retainer that is provided on a side of the first grounding portion in a the axial direction of the rotation shaft, and that has an outside diameter that is larger than an outside diameter of the first grounding portion along an entirety of an outer periphery of the first grounding portion, wherein the grounding retainer completely surrounds the outer periphery of the first grounding portion when viewed along the axial direction of the rotation shaft, and wherein the grounding retainer has a shaft hole having a notch formed through the grounding retainer in an axial direction of the grounding retainer; and a second grounding portion that is elastically held in contact with the first grounding portion.

9. The grounding structure of claim 8, wherein the grounding member is conductive in its entirety, and the grounding member includes a restraint portion which restrains the grounding member from moving in the axial direction of the rotation shaft.

10. The grounding structure of claim 9, wherein the first grounding portion is sandwiched between two grounding retainers that form a circumferential groove; and each of the two grounding retainer includes a convex stripe as the restraint portion, each convex stripe is formed on an outer side of the circumferential groove in the axial direction of the rotation shaft.

11. A sheet transport apparatus comprising the grounding structure of claim 1, wherein the rotation shaft transports a sheet, and the grounding structure grounds the rotation shaft.

12. An image formation apparatus comprising:

an image formation section that forms an image on a sheet to be transported; and the sheet transport apparatus of claim 11.

13. The grounding structure of claim 8, wherein the notch extends toward the outside diameter of the grounding retainer.

14. The grounding structure of claim 8, wherein the protrusion portion of the rotation shaft fits into the notch of the shaft hole of the grounding retainer.

15. A grounding structure comprising:

a rotation shaft that has a non-circular cross section, and that rotates; and a grounding member that is attached to the rotation shaft to electrically communicate with the rotation shaft, and that rotates together with the rotation shaft, wherein the grounding member includes:

a first grounding portion of which outer shape is a circular shape;

a grounding retainer that is provided on a side of the first grounding portion in a shaft direction of the rotation shaft, and that has a larger outside diameter larger than an outside diameter of the first grounding portion;

a second grounding portion that is elastically held in contact with the first grounding portion;

wherein the first grounding portion is sandwiched between two grounding retainers that form a circumferential groove; and wherein each of the two grounding retainers includes a convex stripe as the restraint portion, and the convex stripe is present on an outer side of the circumferential groove in an axial direction of the rotation shaft.

16. The grounding structure of claim 1, wherein the grounding retainer is provided on both sides of the first grounding portion in the axial direction of the rotation shaft.

17. The grounding structure of claim 4, wherein the grounding retainer is provided on both sides of the first grounding portion in the axial direction of the rotation shaft.

18. The grounding structure of claim 8, wherein the grounding retainer is provided on both sides of the first grounding portion in the axial direction of the rotation shaft.

* * * * *